US011667145B2

(12) United States Patent
Davoine et al.

(10) Patent No.: US 11,667,145 B2
(45) Date of Patent: Jun. 6, 2023

(54) PERSONALIZABLE COLOR-SHIFTING DATA CARRIER

(71) Applicant: THALES DIS FRANCE SAS, Meudon (FR)

(72) Inventors: Laurent Davoine, Aarau (CH); Christopher Knud Haas, Austin, TX (US)

(73) Assignee: THALES DIS FRANCE SAS, Meudon (FR)

( * ) Notice: Subject to any disclaimer, the term of this patent is extended or adjusted under 35 U.S.C. 154(b) by 92 days.

(21) Appl. No.: 17/105,592

(22) Filed: Nov. 26, 2020

(65) Prior Publication Data

US 2022/0161590 A1 May 26, 2022

(51) Int. Cl.

| | |
|---|---|
| ***B42D 25/355*** | (2014.01) |
| ***B42D 25/435*** | (2014.01) |
| ***B42D 25/29*** | (2014.01) |
| ***B42D 25/351*** | (2014.01) |
| ***B42D 25/41*** | (2014.01) |

(52) U.S. Cl.

CPC ..... *B42D 25/355* (2014.10); *B42D 25/435* (2014.10)

(58) Field of Classification Search

CPC .... B42D 25/355; B42D 25/435; B42D 25/29; B42D 25/351; B42D 25/41; B42D 25/324

USPC ..... 283/67, 72, 87, 94, 98, 109, 901

See application file for complete search history.

(56) References Cited

U.S. PATENT DOCUMENTS

2017/0173990 A1* 6/2017 Cape ..... B42D 25/324

* cited by examiner

*Primary Examiner* — Justin V Lewis

(57) ABSTRACT

A data carrier having at least one optically variable element, at least one surface element, and at least one security element comprising at least part of the at least one optically variable element and at least part of the at least one surface element. The at least one surface element is configured to guide impinging electromagnetic radiation towards the at least one optically variable element. The data carrier is configured such, that electromagnetic radiation is impinging on the at least one surface element under at least a first arrival angle when the data carrier is seen under a first observation angle, and such, that electromagnetic radiation is impinging on the at least one surface element under at least a second arrival angle being different from the first arrival angle when the data carrier is seen under a second observation angle being different from the first observation angle. The at least one optically variable element is configured to reflect at least a first reflection spectrum upon impingement of the electromagnetic radiation being impinging on the at least one surface element under the first arrival angle, whereby the at least one security element appears according to at least a first appearance, and is further configured to reflect at least a second reflection spectrum upon impingement of the electromagnetic radiation being impinging on the at least one surface element under the second arrival angle, whereby the at least one security element appears according to at least a second appearance being different from the first appearance.

14 Claims, 9 Drawing Sheets

PERSONALIZABLE COLOR-SHIFTING DATA CARRIER

TECHNICAL FIELD

The present invention relates to a data carrier comprising at least one security element according to claim 1, a security document comprising such a data carrier according to claim 14, and a method of producing such a data carrier according to claim 15.

PRIOR ART

It is a common desire to protect data carriers being comprised in or constituting security documents such as identity cards, passports, credit cards, bank notes and the like against forgery. In this context color laser imaging technology that is applied onto a data carrier comprising a polycarbonate has been considered as the grail for identification documents for a long time. For example, Lasink and CLS are two main technologies that are known in the art and which are based on said technology. However, this technologies suffer from the drawbacks that the generated images are of a low resolution and the associated manufacturing costs are rather high.

Optical variable devices such as DOVIDs are known and useful features to assess easily by naked eye if a data carrier or a security document is genuine or not. However, counterfeiters manage to remove such DOVIDs by back-grinding and then recombine it with a new personalized core and a backside from another data carrier or security document.

SUMMARY OF THE INVENTION

It is an object of the present invention to overcome the drawbacks of the prior art. It is in particular an object to provide a data carrier comprising at least one security element that provides a high protection against counterfeits and which can be easily produced.

This object is achieved with a data carrier according to claim 1. In particular, a data carrier is provided, which comprises at least one optically variable element, at least one surface element, and at least one security element comprising at least part of the at least one optically variable element and at least part of the at least one surface element. The at least one optically variable element is arranged after the at least one surface element when seen along an extension direction. The at least one surface element is configured to guide impinging electromagnetic radiation towards the at least one optically variable element. The data carrier is configured such, that electromagnetic radiation is impinging on the at least one surface element under at least a first arrival angle when the data carrier is seen under a first observation angle. The data carrier is further configured such, that electromagnetic radiation is impinging on the at least one surface element under at least a second arrival angle being different from the first arrival angle when the data carrier is seen under a second observation angle being different from the first observation angle. The at least one optically variable element is configured to reflect at least a first reflection spectrum upon impingement of the electromagnetic radiation being impinging on the at least one surface element under the first arrival angle, whereby the at least one security element appears according to at least a first appearance. The at least one optically variable element is further configured to reflect at least a second reflection spectrum upon impingement of the electromagnetic radiation being impinging on the at least one surface element under the second arrival angle, whereby the at least one security element appears according to at least a second appearance being different from the first appearance.

That is to say, the present invention proposes a data carrier that comprises at least one security element that is formed by an optically variable element and a surface element. The optically variable element preferably corresponds to at least one of a multi-layer optical film, preferably a thin-film-interference film, a colour film, an optically variable ink, a diffractive element, a grating such as a resonant waveguide grating, optical absorbers, and a plasmonic structure. That is, the optically variable element preferably corresponds to an element that has color-shifting, i.e. wavelength-shifting attributes depending on the incidence angles of impinging electromagnetic radiation. Examples of interference films include Gemalto Thin Color Mirror Films, Gemalto Clear to Cyan Films, and 3M Dichroic Glass Finishes. That is, the optically variable element preferably corresponds to a commercially available element that is well-known in the art. The present invention makes use of this wavelength-shifting attributes associated with the optically variable element by providing at least one surface element that guides impinging electromagnetic radiation towards the optically variable element under different guiding angles depending on the observation angle under which an observer observes the data carrier. Consequently, electromagnetic radiation is impinging on the optically variable element under different impingement angles, such that the optically variable element reflects electromagnetic radiation of different wavelengths depending on the observation angle of the data carrier, whereby the security element appears with different appearances. In other words, by tilting the data carrier the electromagnetic radiation being impinging on the optically variable element has a different incidence angle, i.e. impingement angle. The reflected electromagnetic radiation, i.e. the reflection spectrum, is constituted by wavelengths that are changed accordingly. In this way, the data carrier produces a color variation in accordance with the tilt angle. Said tilt angle in turn is determined by the observation angle under which the observer observes the data carrier. The optically variable element results in a security element having a bright color appearance with high saturation in reflection at a specific observation angle. Furthermore, the security element has a high level of security because it is composed of elements that interplay with one another. If a forger manipulates the data carrier by removing the surface element, for example, this interplay is destroyed and the forgery becomes evident. In this regard it should be noted that the security element can be provided in various designs. For example, the security element could correspond to a machine-readable security element. However, it is likewise conceivable that the security element is configured to be human readable.

The electromagnetic radiation being impinging on the data carrier, in particular on the at least one surface element, preferably corresponds to ultraviolet light and/or visible light and/or infrared light. In the case of ultraviolet light and infrared light a corresponding ultraviolet source such as a black lamp or an infrared source such as an infrared heater are conceivable irradiation sources for irradiating the electromagnetic radiation onto the data carrier. Visible light can be provided by ambient light such as day light or a regular light source such as a flash lamp, for example.

The first and second observation angles preferably correspond to the viewing angles under which an observer is observing the data carrier.

It should be noted that the expressions "electromagnetic radiation" and "spectrum" as used herein can in each case be constituted by a single wavelength only. More preferably, however, said electromagnetic radiation and/or spectrum in each case comprises two or more, in particular several wavelengths. Depending on the characteristics of the surface element, see further below, electromagnetic radiation being composed of two or more wavelengths is therefore guided by or impinging on the surface element or the optically variable element under a set of angles, which can be referred to as a cone of angles. Within one set of angles or within one cone of angles the individual angles associated with the individual wavelengths constituting the electromagnetic radiation or the spectrum can be different from one another.

Hence, the at least one surface element is preferably configured to guide impinging electromagnetic radiation towards the at least one optically variable element such, that said electromagnetic radiation is impinging on the optically variable element under at least a first impingement angle (or a first set or cone of impingement angles) when the data carrier is seen under the first observation angle. The at least one surface element is preferably further configured to guide impinging electromagnetic radiation towards the at least one optically variable element such, that said electromagnetic radiation is impinging on the optically variable element under at least a second impingement angle (or a second set or cone of impingement angles) being different from the first impingement angle (or first set or cone of impingement angles) when the data carrier is seen under the second observation angle. The at least one optically variable element is preferably configured to reflect the first reflection spectrum upon impingement of the electromagnetic radiation under the first impingement angle (or first set or cone of impingement angles) and to reflect the second reflection spectrum upon impingement of the electromagnetic radiation under the second impingement angle (or second set or cone of impingement angles).

The observation angles and the arrival angles are preferably linked to tilting angles by which the data carrier is tilted. In particular, if the data carrier is tilted, the electromagnetic radiation is incident on the optically variable element under a different impingement angle as compared to a non-tilted data carrier. The reflection spectrum is changed accordingly. That is, the data carrier enables a colour variation of the security element according to the tilting angle. Thus, if the observer is looking at the data carrier in an untilted state, then said first observation angle is e.g. about 60° with respect to a (imaginary) plane that runs through a top surface of the data carrier. Said top surface corresponds to the surface on which the surface element is arranged or formed from. If the observer is looking at the data carrier in a tilted state, for example by tilting the data carrier by about 20° with respect to said plane, then said second observation angle corresponds to the difference between the first observation angle and the tilting angle, i.e. here to the difference between 60° and 20°, thus to 40°.

Hence, the observation angles, and therefore the viewing angles, can be defined as the angles that are formed between the viewing direction and a plane of the data carrier that extends perpendicularly to the extension direction. The impingement angle under which the electromagnetic radiation is impinging on the optically variable element in turn depends on the arrival angle of the electromagnetic radiation on the surface element.

The optically variable element is preferably configured such, that it is transparent for impinging electromagnetic radiation constituting a first impingement spectrum and that it is reflective for impinging electromagnetic radiation constituting a second impingement spectrum being different from the first impingement spectrum.

An optically variable element being transparent for electromagnetic radiation being composed of certain one or more wavelengths is understood as being an element through which impinging electromagnetic radiation can travel without being reflected or absorbed.

Such a transparent optically variable element can also be referred to as a transmissive optically variable element. An optically variable element being reflective for electromagnetic radiation being composed of certain one or more wavelengths is understood as being an element that reflects at least part of the impinging electromagnetic radiation.

The optically variable element is preferably arranged within the data carrier with respect to the extension direction such, that the optically variable element lies above or below or essentially at a focus of the electromagnetic radiation being guided from the surface element to the optically variable element. Additionally or alternatively a vertical distance between the surface element and the optically variable element with respect to the extension direction is preferably such, that a focus of the electromagnetic radiation being guided from the surface element to the optically variable element lies above or below or essentially at the optically variable element with respect to the extension direction.

Depending on the focusing properties of the surface element and/or the distance by which the optically variable element is separated from the surface element the impingement angle under which the electromagnetic radiation impinges on the optically variable element and consequently the appearance of the security element can be tuned. In particular, if the focusing properties and/or the distance are chosen such, that electromagnetic radiation is impinging on the optically variable element under various impingement angles, then a range of the wavelengths being reflected from the optically variable element and transmitted through the surface element towards an outside can be reduced. For example, if the focus of the electromagnetic radiation lies below the optically variable element with respect to the extension direction, electromagnetic radiation will impinge on the optically variable element under different impingement angles or under a set or cone of impingement angles that differ from one another. Said difference preferably is more than 10°, more preferably more than 20°, particularly preferably about 30°. Consequently, the reflection spectrum that is comprised of electromagnetic radiation being reflected from the optically variable element also comprises different wavelengths, i.e. different colors. For example, it is conceivable to provide a data carrier wherein the colors red, green and blue are reflected. If the focusing properties of the surface element are changed such as increasing its focal length then the range of impingement angles under which the electromagnetic radiation is impinging on the optically variable element is reduced. As a result, the reflection spectrum being reflected from the optically variable element comprises essentially one or a few wavelengths. For example, it is conceivable to provide a data carrier wherein only the color green is reflected. A vertical distance between a surface of the data carrier on which the surface element is arranged on and the optically variable element with respect to the extension direction is preferably between 0 to 800 micrometer, more preferably about 150 micrometer.

The optically variable element is preferably configured such, that the electromagnetic radiation that impinges on the surface element under the at least one first arrival angle and the electromagnetic radiation constituting the at least one first reflection spectrum are essentially the same or different from one another. Additionally or alternatively the optically variable element is preferably configured such, that the electromagnetic radiation that impinges on the surface element under the at least one second arrival angle and the electromagnetic radiation constituting the at least one second reflection spectrum are essentially the same or different from one another.

To this end a difference could manifest itself in different one or more wavelengths that constitute the impinging electromagnetic radiation and the reflection spectrum, and/or a different intensity or intensity distribution of the impinging electromagnetic radiation and the reflection spectrum, and/or a different polarization or polarization distribution of the impinging electromagnetic radiation and the reflection spectrum, for example.

The optically variable element is preferably configured to transmit at least part of the electromagnetic radiation upon impingement of the electromagnetic radiation being impinging on the at least one surface element under the at least one first arrival angle as at least a first transmittance spectrum, and wherein the at least one first transmittance spectrum differs from the at least one first reflection spectrum. Additionally or alternatively the optically variable element is preferably configured to transmit at least part of the electromagnetic radiation upon impingement of the electromagnetic radiation being impinging on the at least one surface element under the at least one second arrival angle as at least a second transmittance spectrum, and wherein the at least one second transmittance spectrum differs from the at least one second reflection spectrum.

Hence, and as has been already mentioned above, the optically variable element can be configured to have its own transmittance spectrum that depends on the incidence angle, i.e. the impingement angle under which the electromagnetic radiation impinges on the optically variable element. At any impingement angle, the ratio for each wavelength is given by:

$$T=1-R-A,$$

wherein T refers to the transmittance spectrum, wherein R refers to the reflection spectrum, and wherein A refers to the absorption spectrum, i.e. electromagnetic radiation being absorbed by the optically variable element.

In the event that no absorption takes place within the optically variable element, then said ratio is given by:

$$T=1-R.$$

Hence, if no absorption takes place inside the optically variable element then the transmittance spectrum and the reflection spectrum are complementary to one another.

The data carrier, in particular the surface element, preferably comprises at least one blocking element, and wherein said blocking element is configured to block impinging electromagnetic radiation, whereby a further impingement of said electromagnetic radiation on the optically variable element is prevented and/or whereby electromagnetic radiation being reflected from the optically variable element is blocked.

The blocking element preferably corresponds to at least one of a laser marking and an opaque material such as a foil or layer that preferably comprises a metal-compound.

The laser marking is preferably achieved by means of a standard laser engraving process, wherein laser radiation is irradiated onto the data carrier so as to produce a preferably black laser marking in the data carrier. If an opaque material is provided in the data carrier, said opaque material is preferably selectively removed, e.g. again by means of an irradiation of laser radiation, whereby the remaining opaque material constitutes the blocking element. For example, in order to produce personalizable color images at a specific observation angle, one could use standard laser engraving processes as they are known in the art. Indeed by the help of a laser source, a local darkening of the data carrier can be achieved. Therefore, by choosing properly the location of the darkening, one can prevent certain wavelengths, i.e. colors, from being reflected from the data carrier towards an outside or from being impinging on the optically variable element. In order to perform an engraving at a precise location, one can use one or more registration marks located somewhere on the data carrier. Said registration marks can be used for the alignment of the engraving system. It is furthermore preferred if the blocking element corresponds to a pixel of at least one of an alphanumeric character and an image. That is, it is preferred to provide blocking elements, wherein each blocking element corresponds to one pixel of an image or an alphanumeric character, and wherein each pixel participates in the selective blocking of a particular wavelength or wavelengths, i.e. of a particular colour. The form of each pixel can be approximated as a round shape, wherein a pixel size is preferably between 10 micrometer and 100 micrometer, more preferably between 20 micrometer and 50 micrometer, particularly preferably around 40 micrometer. The one or more blocking elements are preferably generated in a region of the surface element, for example on a top surface of the surface element or below said top surface. The provision of one or more blocking elements brings additional value since they allow a personalization of the data carrier after the data carrier production.

It is preferred when two or more surface elements are provided in an array and/or according to a pattern, in particular a pixelated pattern.

That is to say, the data carrier preferably comprises two, even more preferably a plurality of surface elements, wherein said surface elements are preferably arranged in a particular relationship to one another. For example, they can be arranged as a one-dimensional or two-dimensional array that extends along a transverse direction running perpendicularly to the extension direction. Alternatively, said surface elements can be distributed according to a pattern within a plane that runs perpendicularly to the extension direction. A pixelated pattern is understood here as a pattern of surface elements, wherein each surface element is associated with the generation of one or more particular colours being reflected from the data carrier. For example, surface elements that result in the reflection of red, green and blue colours could be provided, which can be used as red-green-blue (RGB) pixels in order to produce a coloured image at high resolution. By generating one or more blocking elements, said coloured image could be personalized as described above. Furthermore, said blocking elements can be used to block certain colours.

The data carrier preferably further comprising at least one further surface element that is configured to guide impinging electromagnetic radiation towards the optically variable element, wherein the data carrier is further configured such, that electromagnetic radiation is impinging on the at least one further surface element under at least a further first arrival angle when the data carrier is seen under the first observation angle, and wherein the at least one optically variable element is configured to reflect at least a further first reflection spectrum upon impingement of the electromagnetic radiation being impinging on the at least one further surface element under the further first arrival angle that is different from the first reflection spectrum, whereby the at least one security element appears according to at least a further first appearance that is different from the first appearance. Additionally or alternatively the data carrier is preferably further configured such, that electromagnetic radiation is impinging on the at least one further surface element under at least a further second arrival angle when the data carrier is seen under the second observation angle, and wherein the at least one optically variable element is configured to reflect at least a further second reflection spectrum upon impingement of the electromagnetic radiation being impinging on the at least one further surface element under the further second arrival angle that is different from the second reflection spectrum, whereby the at least one security element appears according to at least a further second appearance that is different from the second appearance.

That is to say, it is conceivable that the data carrier comprises at least one further surface element that results in a second reflection spectrum being different from the first reflection spectrum, and therefore in a second appearance of the security element being different from the first appearance, when the data carrier is observed under the first observation angle and/or under the second observation angle.

Any explanations provided with respect to the one or more surface elements likewise apply to the one or more further surface elements.

For example, the two or more further surface elements can be provided in a further array and/or according to a further pattern, in particular a further pixelated pattern. To this end it is also conceivable that at least one surface element and at least one further surface element are provided in a combined array and/or according to a combined pattern, in particular a combined pixelated pattern. It is furthermore conceivable that one of (i) a vertical distance between the surface element and the optically variable element with respect to the extension direction equals to or is different from a further vertical distance between the further surface element and the optically variable element with respect to the extension direction, and (ii) the surface element and the further surface element are arranged immediately adjacent to one another or at a horizontal distance from one another with respect to a transverse direction running perpendicularly to the extension direction.

The surface element and/or the further surface element preferably comprises or consist one or more lenses. Furthermore, the one or more lenses preferably are of a cylindrical lens shape and/or of a spherical lens shape.

Moreover, a shape, in particular a focal length and/or an angular aperture of the lens being provided by the surface element(s) and of the lens being provided by the further surface element(s) are the same or different from one another.

Hence, it is preferred that the one or more surface elements and/or the one or more further surface elements correspond to lenses. A focal length of the lenses constituting the surface elements and a focal length of the lenses constituting the further surface elements can be the same or different from one another. Additionally or alternatively it is preferred that an f-number associated with the lenses constituting the surface elements and an f-number associated with the further surface elements are the same or different from one another. It is particularly preferred that a focal length of the lenses constituting the surface elements is in the range of 50 micrometer to 3000 micrometer, in particular 150 micrometer, and/or that a focal length of the lenses constituting the further surface elements is in the range of 50 micrometer to 3000 micrometer, in particular 300 micrometer, and/or that an f-number associated with the lenses constituting the surface elements is in the range of 1.0 to 10.0, in particular 1.2, and/or that that an f-number associated with the lenses constituting the further surface elements is in the range of 1.0 to 10.0, in particular 2.4.

Furthermore, at least two of the surface elements, in particular lenses, are arranged such that, when the data carrier is seen under the first observation angle and/or under the second observation angle, impinging electromagnetic radiation impinges on the data carrier via one of these two surface elements and is reflected from the data carrier via the other of these two surface elements, and wherein a lateral distance between these two surface elements with respect to a transverse direction running perpendicularly to the extension direction is between 50 micrometer to 3000 micrometer, preferably about 125 micrometer.

The same applies in the event that two or more further surface elements, in particular lenses, are present on the data carrier.

These at least two surface elements and/or at least two further surface elements are referred to as two involved lenses.

For a given optically variable element and at a given observation angle the wavelengths that are out-coupled from the data carrier are dictated by the f-number of the lenses, the lenses focal lengths, a vertical distance between the top surface of the data carrier and the optically variable element, and a lateral distance between two involved lenses, i.e. between a lens that guides impinging electromagnetic radiation towards the optically variable element and a lens through which the reflected electromagnetic radiation is out-coupled from the data carrier as just explained. In other words, by appropriately choosing one or more of these parameters it is possible to provide a data carrier with a security element having a desired appearance.

It is furthermore preferred to provide one or more lenses, wherein each lens is configured to produce one particular color at one particular pixel. To this end the geometry of the lens is preferably selected such, that it results in the generation of one particular color. It is furthermore preferred to distribute different types of lenses such, that the lenses result in the generation of red, green and blue colors. In other words, it is preferred to distributed the lenses as RGB pixels. Alternatively, it is conceivable to provide one or more lenses which are in each case configured to generate two or more colours.

The surface element and/or the further surface element preferably comprise or consist of a polymer, preferably a thermoplastic polymer, particularly preferably polycarbonate. Any further components, with the exception of the optically variable element, preferably likewise comprise or consist of a polymer, preferably a thermoplastic polymer, particularly preferably polycarbonate.

The data carrier preferably further comprises a transparent region, wherein the security element, preferably the optically variable element and the surface element and/or the further surface element, is arranged within said region and/or before said region with respect to the extension direction and/or after said region with respect to the extension direction.

The transparent region can be understood as a window region or windowed embodiment. The transparent region is preferably provided by means of transparent plastics, particularly preferably by transparent thermoplastics such as polycarbonate. If a white region is placed below the transparent region and therefore below the optically variable element with respect to the extension direction, the white region results in a reflection of electromagnetic radiation being transmitted through the optically variable element and the transparent region and being impinging on said white region. If a black region is placed below the transparent region and therefore below the optically variable element with respect to the extension direction, said black region will absorb any electromagnetic radiation that is transmitted through the optically variable element and the transparent region and which is impinging on the black region. If a coloured region is placed below the transparent region and therefore below the optically variable element with respect to the extension direction, said coloured region participates in the formation of an overall reflected colour comprising emitted radiation from the coloured region upon its excitation with the impinging electromagnetic radiation according to the additive color mixing scheme.

The data carrier preferably further comprises at least one masking element, wherein said masking element is arranged before the optically variable element with respect to the extension direction, and wherein said masking element is configured such that, depending on the electromagnetic radiation being reflected from the optically variable element, the masking element is invisible or visible to an observer.

The masking element preferably is coloured and particularly preferably corresponds to a coloured print.

In a further aspect a security document comprising or consisting of at least one data carrier as described above is provided the security document preferably being an identity card, a passport, a credit card, a bank note or the like. That is, the data carrier per se can correspond to a security document. Or, the data carrier can be part of a security document. For example, in the case of a passport it is conceivable to incorporate the data carrier into a page of the passport.

In a further aspect a method of producing a data carrier, preferably a data carrier as described above, is provided, wherein the method comprising the steps of (i) providing at least one optically variable element, (ii) providing at least one surface element, and (iii) providing at least one security element comprising at least part of the at least one optically variable element and at least part of the at least one surface element. The at least one optically variable element is arranged after the at least one surface element when seen along an extension direction. The at least one surface element is configured to guide electromagnetic radiation that is impinging on the at least one surface element to the at least one optically variable element. The data carrier is configured such, that electromagnetic radiation is impinging on the at least one surface element under at least a first arrival angle when the data carrier is seen under a first observation angle. The data carrier is further configured such, that electromagnetic radiation is impinging on the at least one surface element under at least a second arrival angle being different from the first arrival angle when the data carrier is seen under a second observation angle being different from the first observation angle. The at least one optically variable element is configured to reflect at least a first reflection spectrum upon impingement of the electromagnetic radiation being impinging on the at least one surface element under the first arrival angle, whereby the at least one security element appears according to at least a first appearance. The at least one optically variable element is further configured to reflect at least a second reflection spectrum upon impingement of the electromagnetic radiation being impinging on the at least one surface element under the second arrival angle, whereby the at least one security element appears according to at least a second appearance being different from the first appearance.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

FIG. 1*a* to 5 depict different schematically sectional views of a data carrier comprising at least one surface element according to the invention. Real examples of such data carriers are illustrated by means of the photographs depicted in FIGS. 6*a* to 8.

Hence, the data carrier 1 according to the invention comprises at least one optically variable element 2 and at least one surface element 3*a*. The optically variable element 2 is arranged after the surface element 3*a* when seen along an extension direction E extending from the surface element 3*a* towards the optically variable element 2. The surface element 3*a* is configured to guide impinging electromagnetic radiation EM towards the optically variable element 2. In fact, the data carriers 1 depicted in the figures comprise a plurality of surface elements 3*a* which form arrays and which are furthermore arranged according to a pattern.

In addition, said surface elements 3*a* are arranged immediately adjacent to one another with respect to a transverse direction T extending perpendicularly to the extension direction E. In addition, the surface elements 3*a* correspond here to lenses which are in each case of a cylindrical shape. The optically variable element 2 corresponds to at least one of a multi-layer optical film, preferably a thin-film-interference film, a colour film, an optically variable ink, a diffractive element, a grating such as a resonant waveguide grating, optical absorbers, and a plasmonic structure. That is, the optically variable element 2 corresponds to an element that is configured to reflect and/or transmit electromagnetic radiation EM in dependency of an observation angle γ1, γ2 under which the data carrier 1, and therefore the optically variable element 2, is observed by an observer. At least a part of the optically variable element 2 and at least a part of the surface element 3*a* participate in the formation of at least one security element 4. Hence, by selectively providing one or more surface elements 3*a* in combination with the optically variable element 2 it is possible to select specific electromagnetic radiation EM that is reflected from and/or transmitted through the optically variable element 2. This phenomenon shall be further illustrated by means of FIGS. 1*a* to 5.

Figure 1A:
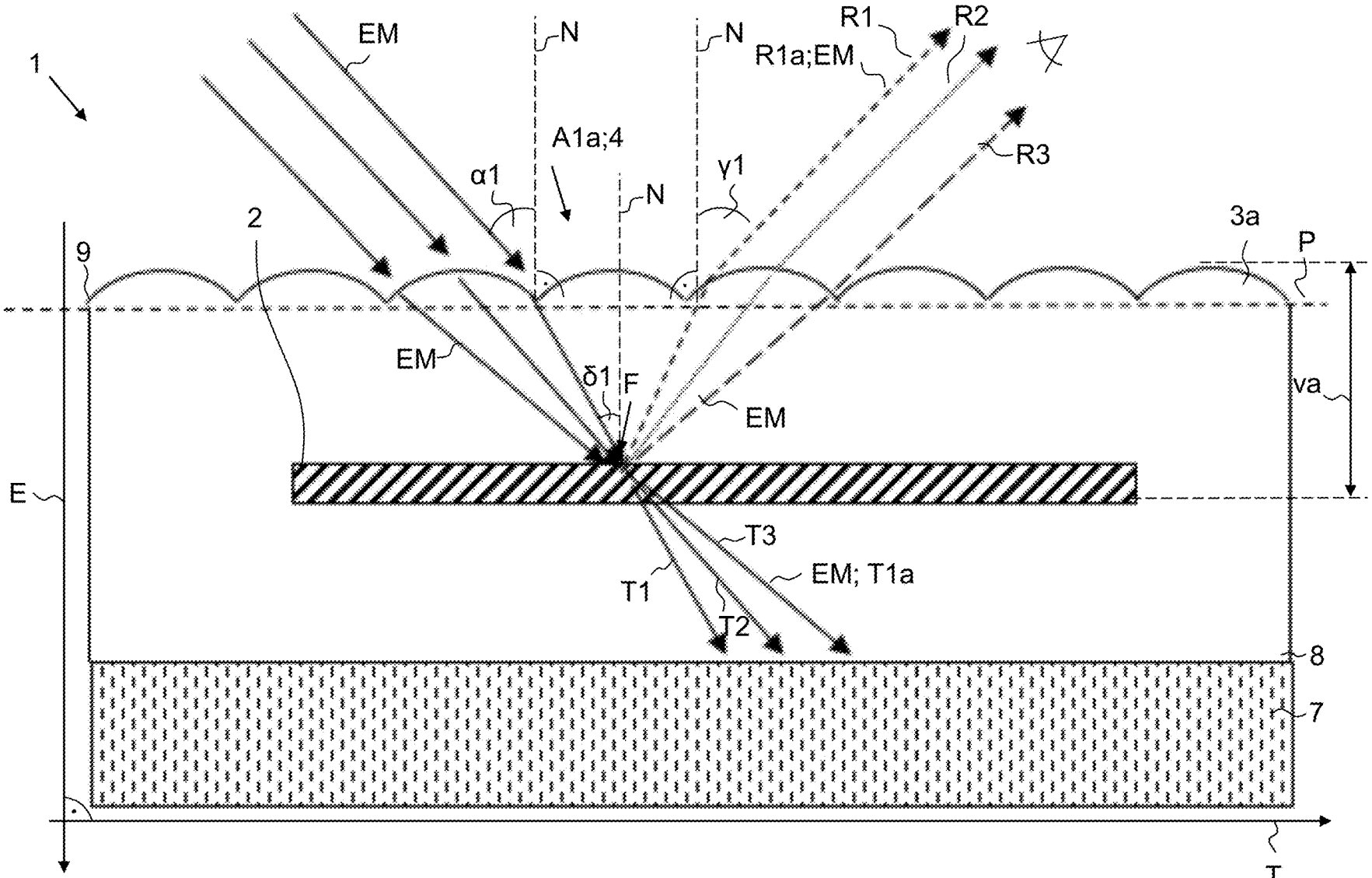
FIG. 1*a* shows a sectional view through a data carrier comprising an optically variable element and surface elements viewed under a first observation angle.

That is, FIG. 1*a* depicts a data carrier 1 comprising an array of lens elements 3*a* of the same type and the same geometries. Also a vertical distance va between the lens elements 3*a* and the optically variable element 2 is for each lens element 3*a* the same. Here, the data carrier 1 is observed under a first observation angle γ1, wherein electromagnetic radiation EM is impinging on the lens elements 3*a* under a first arrival angle α1. An impingement of electromagnetic radiation EM under said first arrival angle α1 results in a reflection of electromagnetic radiation EM from the optically variable element 2 as well as in a transmission of electromagnetic radiation EM through the optically variable element 2. The reflected electromagnetic radiation EM is designated here as a first reflection spectrum R1*a* and the transmitted electromagnetic radiation EM is designated as first transmittance spectrum T1*a*. Since the reflected electromagnetic radiation EM does not encounter any blocking elements or the like which could block said electromagnetic radiation EM, the electromagnetic radiation EM can travel through the data carrier 1 towards an outside of the data carrier 1 such that the first reflection spectrum R1*a* will be visible to or detectable by an observer. However, since the data carrier 1 comprises a bottom element 7, here an opaque layer, the electromagnetic radiation EM being transmitted through the optically variable element 2 and constituting the first transmittance spectrum T1*a* impinges on said bottom element 7 where it is scattered in all directions or absorbed. The first security element 4 therefore appears according to a first appearance A1*a* which is constituted by the first reflection spectrum R1*a*.

Figure 1B:
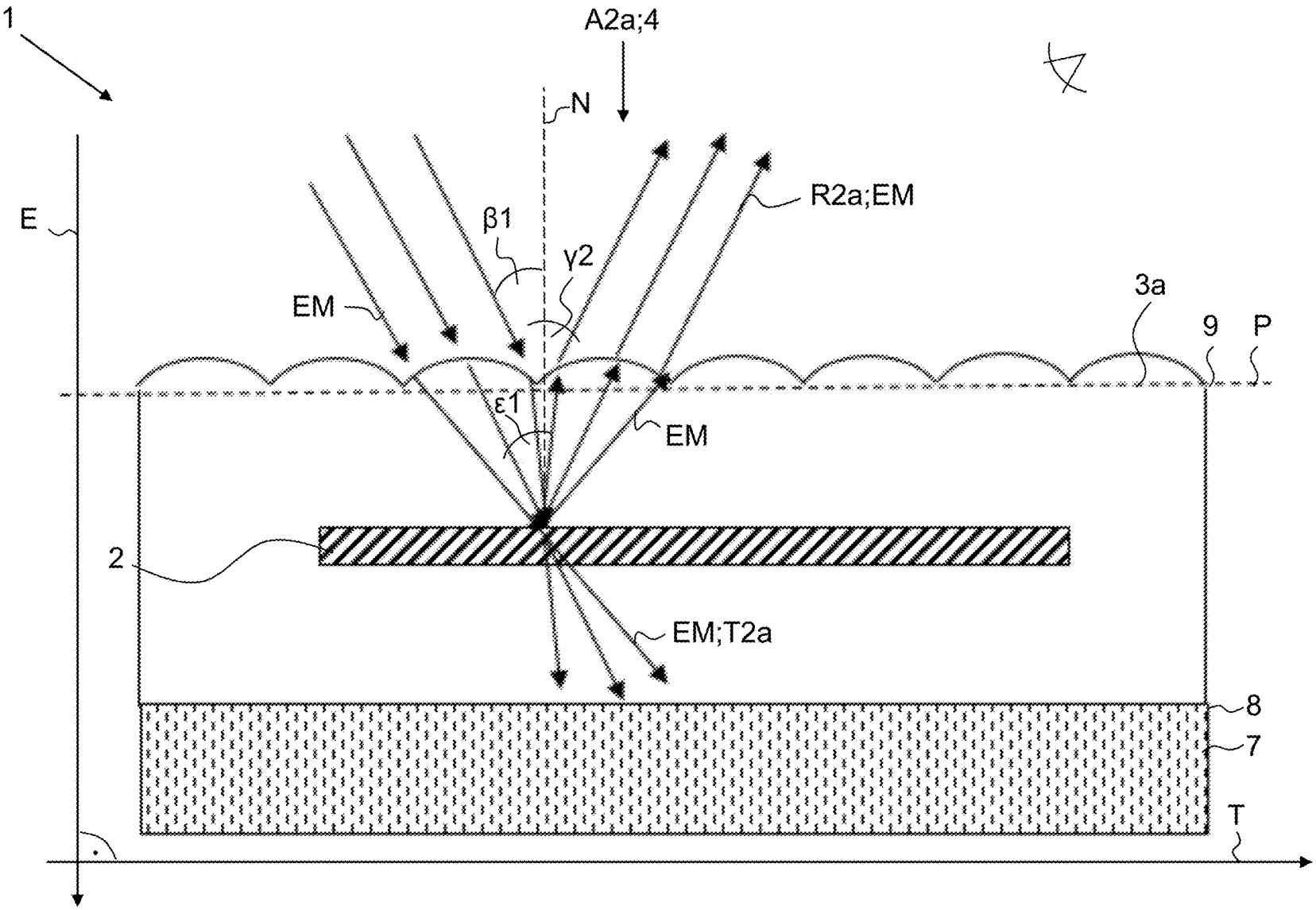
FIG. 1*b* shows a sectional view through a data carrier according to FIG. 1*a* viewed under a second observation angle.

FIG. 1*b* depicts the data carrier 1 according to FIG. 1*a*, however in a tilted manner. That is, the data carrier 1 is seen under a second observation angle γ2 being different from the first observation angle γ1. As a result, electromagnetic radiation EM is impinging on the lens elements 3*a* under a second arrival angle β1 being different from the first arrival angle α1. Upon impingement of the electromagnetic radiation EM being impinging on the lens elements 3*a* under the second arrival angle β1, the optically variable element 2 is configured to reflect a second reflection spectrum R2*a*. Since said second reflection spectrum R2*a* differs from the first reflection spectrum R1*a* the security element 4, when seen in this tilted manner, appears according to a second appearance A2*a* being different from the first appearance A1*a*. It should be noted that also in this case some electromagnetic radiation EM is transmitted through the optically variable element 2 and forms a second transmittance spectrum T2*a*. However, because of the bottom layer 7 being arranged on a bottom side 8 of the data carrier 1 said second transmittance spectrum T2*a* is likewise scattered or absorbed by the bottom layer 7.

Hence, when the data carrier 1 is tilted, the electromagnetic radiation EM is incident on the surface element 3*a* under a different arrival angle β1*as* compared to the arrival angle α1 associated with the non-tilted data carrier 1. The reflection spectrum R2*a* and/or the transmission spectrum T2*a* and therefore an appearance A2*a* of the security element 4 is changed accordingly. That is, the data carrier 1 enables a color variation of the security element 4 according to the tilt angle. The electromagnetic radiation being impinging on the data carrier 1, in particular on the lens elements 3*a*, preferably corresponds to ultraviolet light, visible light, or infrared light. In the case of ultraviolet light and infrared light a corresponding ultraviolet source such as a black lamp or an infrared source such as an infrared heater are conceivable irradiation sources for irradiating the electromagnetic radiation onto the data carrier. Visible light can be provided by ambient light such as day light or a regular light source such as a flash lamp, for example. Depending on the optical properties of the optically variable element 2 and the angle under which it is impinged by the electromagnetic radiation EM, the optically variable element 2 is configured to reflect and/or transmit electromagnetic radiation EM corresponding to ultraviolet light, visible light, or infrared light. As is readily evident from these figures, the first and second observation angles γ1, γ2 preferably correspond to the viewing angles under which an observer is viewing the data carrier 1. The observation angles γ1, γ2, and therefore the viewing angles, can be defined as the angles that are formed between the viewing direction and a (fictitious) normal N to a (fictitious) plane P of the data carrier 1 that extends perpendicularly to the extension direction E. Said plane P runs through an uppermost surface 9 of the data carrier 1, on which the at least one surface element 3*a* is arranged. In the present examples, the plane P is indicated by dashed lines at a location in the data carrier 1 where the lens elements 3*a* are formed. Similarly, the first and the second arrival angle α1, β1 are defined here in each case as the angle which is formed between the light rays of electromagnetic radiation EM being impinging on the lens elements 3*a* and the normal N to said plane P.

As has already been mentioned, the lens elements 3*a* are configured to guide impinging electromagnetic radiation EM towards the at least one optically variable element 2. In fact, the lens elements 3*a* are preferably configured such, that said electromagnetic radiation EM is impinging on the optically variable element 2 under at least a first impingement angle δ1 when the data carrier 1 is seen under the first observation angle γ1 and under at least a second impingement angle ε1 being different from the first impingement angle δ1 when the data carrier 1 is seen under the second observation angle γ2. Said first and second impingement angles δ1, ε1 are defined here again as the angle which is formed between the light rays of electromagnetic radiation EM coming from the lens elements 3*a* and the normal N to the plane P. To this end it should be noted that, when the data carrier 1 is observed under the first observation angle γ1, the electromagnetic radiation EM coming from the lens elements 3*a* can impinge on the optically variable element 2 under two or more first impingement angles δ1, wherein said two or more first impingement angles δ1 can be the same or different from one another. If electromagnetic radiation EM impinges on the optically variable element 2 under two or more first impingement angles δ1, said two or more first impingement angles δ1 can be said to form a set of first impingement angles or a cone of first impingement angles. Likewise, if the data carrier 1 is observed under the second observation angle γ2, the electromagnetic radiation EM coming from the lens elements 3*a* can impinge on the optically variable element 2 under two or more second impingement angles ε1, wherein said two or more second impingement angles ε1 can be the same or different from one another. If electromagnetic radiation EM impinges on the optically variable element 2 under two or more second impingement angles ε1, said two or more second impingement angles ε1 can be said to form a set of second impingement angles or a cone of second impingement angles. The set of second impingement angles or cone of second impingement angles differs from the set of first impingement angles or cone of first impingement angles. Hence, by tilting the data carrier 1, electromagnetic radiation EM impinges on the optically variable element 2 under different impingement angles. Consequently, the reflection spectra R1*a*, R2*a* and/or the transmission spectra T1*a*, T2*a* and thus the appearance A1*a*, A2*a* of the security element 4 are changed accordingly.

Additionally or alternatively a vertical distance va between the surface element 3*a* and the optically variable element 2 with respect to the extension direction E can be such, that a focus F of the electromagnetic radiation EM being guided from the surface element 3*a* to the optically variable element 2 lies above or below or essentially at the optically variable element 2 with respect to the extension direction E.

As follows from FIG. 1*a*, the focus F of electromagnetic radiation EM being impinging on the optically variable element 2 essentially lies at the optically variable element 2 and at a first position if the data carrier is observed under the first observation angle γ1. However, and as follows from FIG. 1*b*, if the data carrier 1 is tilted and observed under the second observation angle γ2, the focal point of the impinging electromagnetic radiation EM is different from that according to FIG. 1*a*. In fact, in the present example depicted in FIG. 1*b* the focus F is shifted with respect to a transverse direction T running perpendicularly to the extension direction E so as to lie at a second position being spaced from the first position. In other words, the focus F is moving along the transverse direction T according to the viewing angle or when the data carrier is tilted, respectively.

Figure 2:
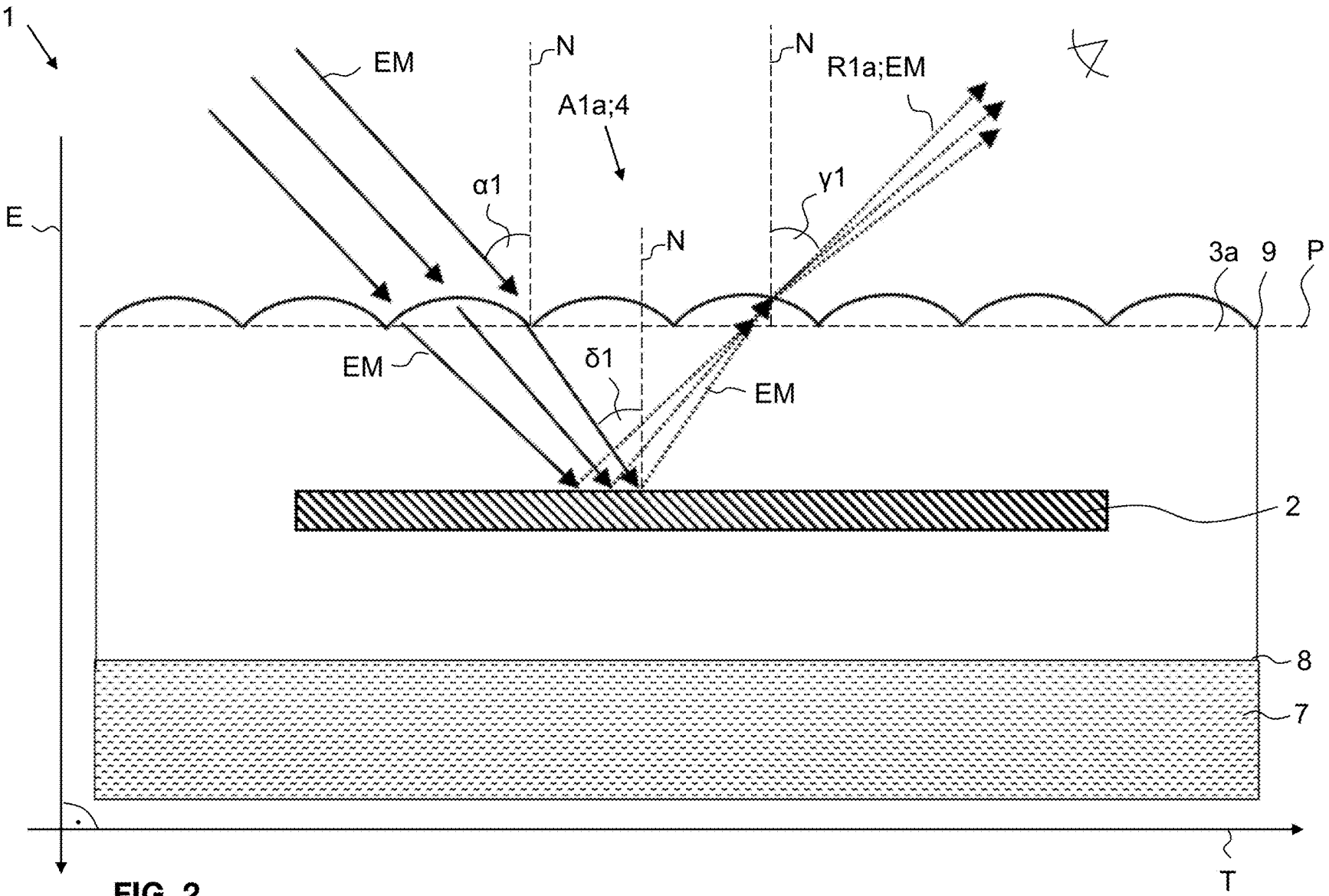
FIG. 2 shows a sectional view through a data carrier comprising an optically variable element and surface elements according to a further embodiment viewed under a first observation angle.

FIG. 2 depicts a data carrier 1 whose lens elements 3*a* are configured such, that the focus F of the electromagnetic radiation EM being guided from the lens elements 3*a* towards the optically variable element 2 lies considerably below the optically variable element 2 with respect to the extension direction E and when the data carrier 1 is observed under the first observation angle γ1. That is, the lens elements 3*a* according to FIG. 2 comprise a focal length that is larger than the focal length of the lens elements 3*a* according to FIGS. 1*a* and 1*b*. The lens diameters of the lens elements 3*a* of the data carriers 1 in FIGS. 1*a* and 1*b* and in FIG. 2 however are the same. As follows from FIG. 2, the lens elements 3*a* and the optically variable element 2 are configured such, that only a first reflection spectrum R1*a* is reflected from the optically variable element 2, whereas no first transmittance spectrum is transmitted through the optically variable element 2. Furthermore, the data carrier 1 according to FIG. 2 differs from the data carrier 1 according to FIGS. 1*a* and 1*b* in that the set of first impingement angles under which the electromagnetic radiation EM impinges on the optically variable element 2 is smaller than the set of first impingement angles under which the electromagnetic radiation EM impinges on the optically variable element 2 according to FIGS. 1*a* and 1*b*. In particular, the data carrier 1 according to FIGS. 1*a* and 1*b* is configured such, that electromagnetic radiation EM constituting white light impinges on the lens elements 3*a* and subsequently on the optically variable element 2 under first impingement angles δ1 and second impingement angles ε1 that differ more from one another than the first impingement angles δ1 under which the electromagnetic radiation EM impinges on the optically variable element 2 according to FIG. 2. In other words, the set of first impingement angles being associated with the data carrier 1 according to FIGS. 1*a* and 1*b* constitute a broader range of first impingement angles δ1 and second impingement angles ε1 than the set of first impingement angles being associated with the data carrier 1 according to FIG. 2. As a consequence, the range of reflected wavelengths that constitute the first reflection spectrum R1*a* is smaller in the case of the data carrier 1 according to FIG. 2 and compared to the range of reflected wavelengths constituting the first reflection spectrum R1*a* and the second reflection spectrum R2*a* according to FIGS. 1*a* and 1*b*. For example, the data carrier 1 according to FIGS. 1*a* and 1*b* can be configured such, that the first reflection spectrum R1*a* comprises wavelengths in the colors red, green and blue when the data carrier 1 is observed under the first observation angle γ1. If said data carrier 1 is tilted or seen under the second observation angle γ2 the second reflection spectrum R2*a* comprises wavelengths in the colors red-orange. Thus, the appearance of the data carrier 1 has changed.

The corresponding first transmittance spectrum T1*a* constitutes a spectrum being essentially complementary or complementary to the first reflection spectrum R1*a*. That is, if no absorption takes place inside the optically variable element 2 then the first reflection spectrum R1*a* is comprised of a first beam R1 of green light, a second beam R2 of red light and a third beam R3 of blue light, then the first transmittance spectrum is comprises of a first beam being T1=1−R1, a second beam being T2=1−R2, and a third beam being T3=1−R3, respectively. In this case, the first transmittance spectrum T1*a* is complementary to the first reflection spectrum R1*a*. However, it is conceivable that absorption takes place within the optically variable element 2, in which case the first transmittance spectrum T1*a* is comprised of a first beam being T1=1−R1−A, a second beam being T2=1−R2−A, and a third beam being T3=1−R3−A, wherein "A" denotes those wavelengths of the electromagnetic spectrum which are absorbed by the optically variable element 2. In this case, the first transmittance spectrum T1*a* is said to be essentially complementary to the first reflection spectrum R1*a*.

Figure 3A:
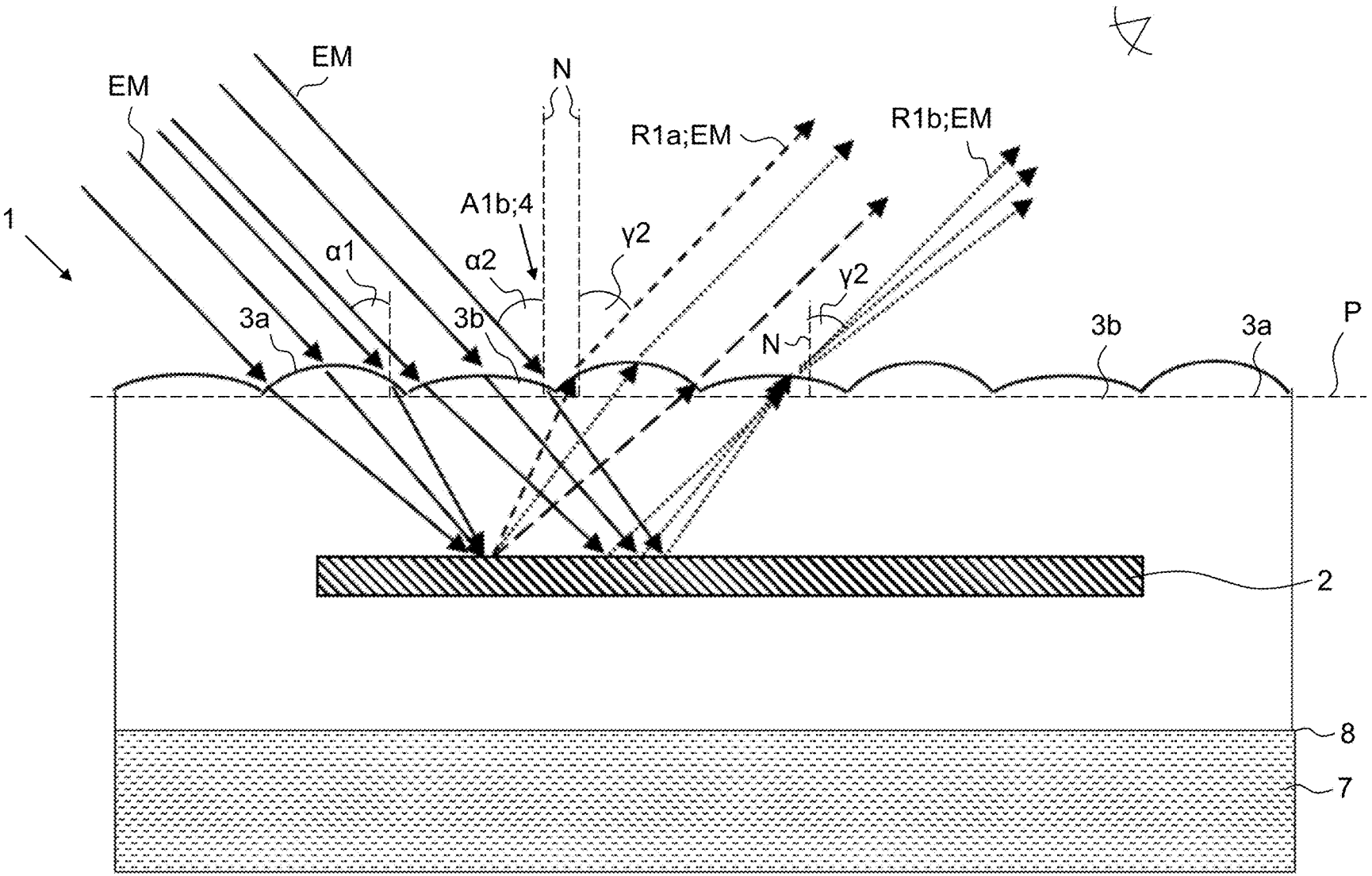
FIG. 3*a* shows a sectional view through a data carrier comprising an optically variable element and surface elements according to a further embodiment viewed under a first observation angle.
Figure 3B:
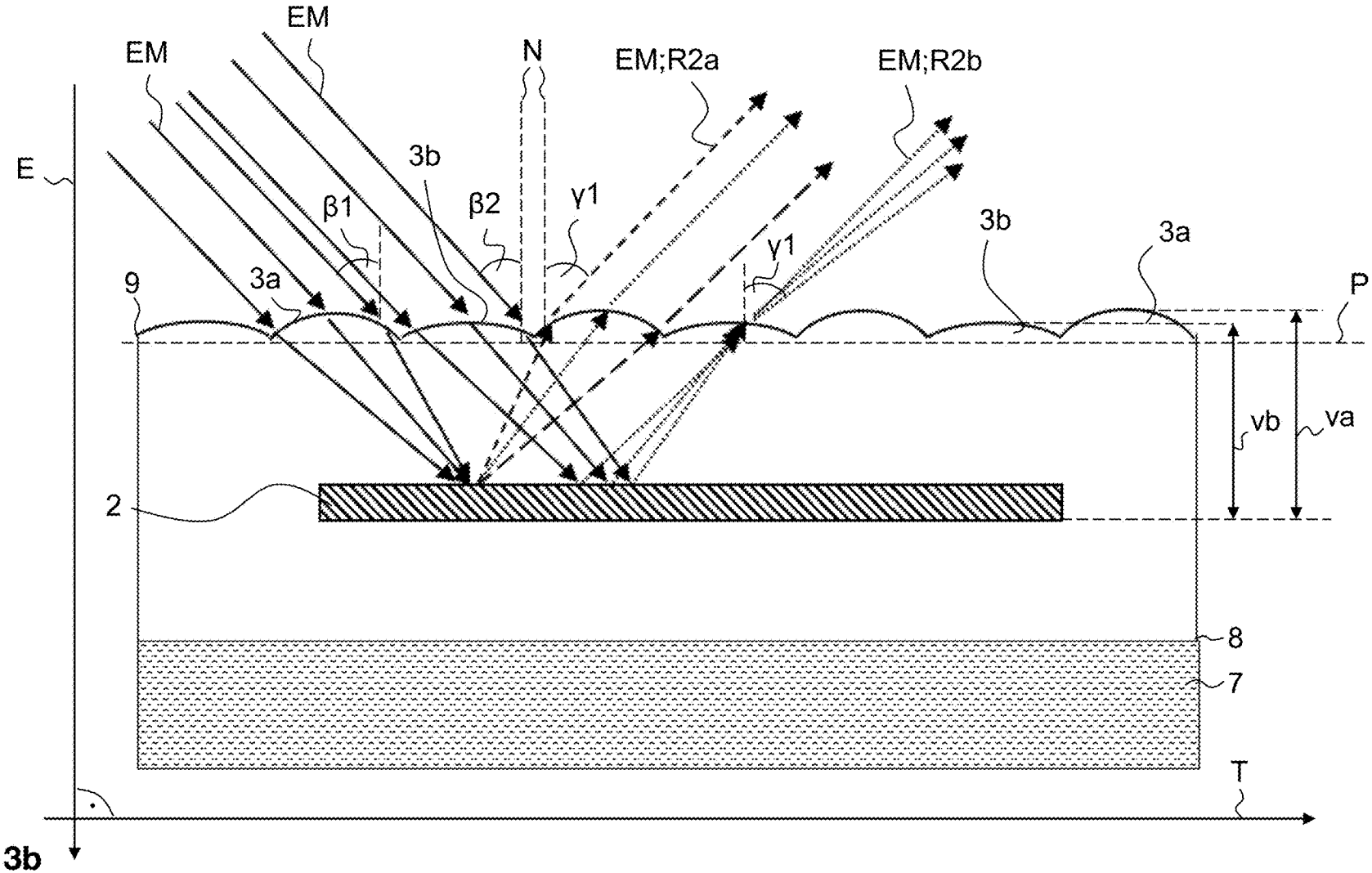
FIG. 3*b* shows a sectional view through a data carrier according to FIG. 3*a* viewed under a second observation angle.

The data carriers 1 depicted in FIGS. 3*a* and 3*b* differ from those depicted in FIGS. 1*a* to 2 in that they comprise different surface elements 3*a*, 3*b*. In fact, the data carriers 1 according to FIGS. 3*a* and 3*b* comprise an array of surface elements 3*a* and further surface elements 3*b*, which are arranged here in an alternating manner and immediately adjacent to one another. The further surface elements 3*b* differ from the surface elements 3*a* in their shape and are arranged at a different vertical distance vb from the optically variable element 2 with respect to the extension direction E. In fact, the further surface elements 3*b* are flatter than the surface elements 3*a* and the vertical distance vb between the further surface elements 3*b* and the optically variable element 2 is smaller than the vertical distance va between the surface elements 3*a* and the optically variable element 2. Consequently, and as follows from FIG. 3*a*, electromagnetic radiation EM is impinging on the further surface elements 3*b* under at least a further first arrival angle α2 being different from the first arrival angle α1 when the data carrier 1 is seen under the first observation angle γ1, and wherein the at least one optically variable element 2 is configured to reflect at least a further first reflection spectrum R1*b* upon impingement of the electromagnetic radiation EM being impinging on the at least one further surface element 3*b* under the further first arrival angle α2 that is different from the first reflection spectrum R1*a*, whereby the at least one security element 4 appears according to at least a further first appearance A1*b* that is different from the first appearance A1*a*. Moreover, and as follows from FIG. 3*b*, electromagnetic radiation EM is impinging on the further surface elements 3*b* under at least a further second arrival angle β2 being different from the second arrival angle β1 when the data carrier 1 is seen under the second observation angle γ2, and wherein the at least one optically variable element 2 is configured to reflect at least a further second reflection spectrum R2*b* upon impingement of the electromagnetic radiation EM being impinging on the at least one further surface element 3*b* under the further second arrival angle β2 that is different from the second reflection spectrum R2*a*, whereby the at least one security element 4 appears according to at least a further second appearance A2*b* that is different from the second appearance A2*a*.

Figure 4:
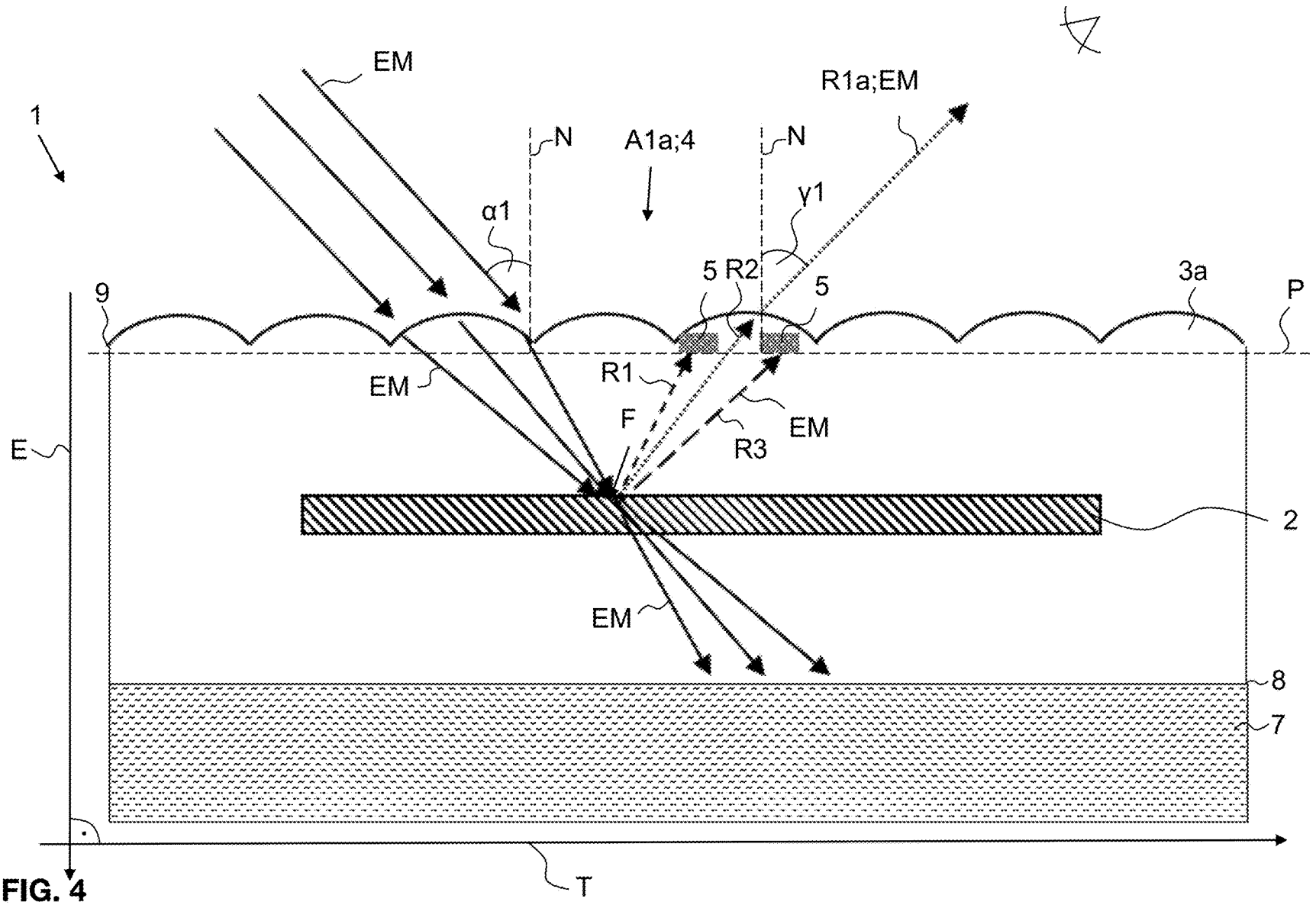
FIG. 4 shows a sectional view through a data carrier comprising an optically variable element and surface elements and blocking elements viewed under a first observation angle.
Figure 5:
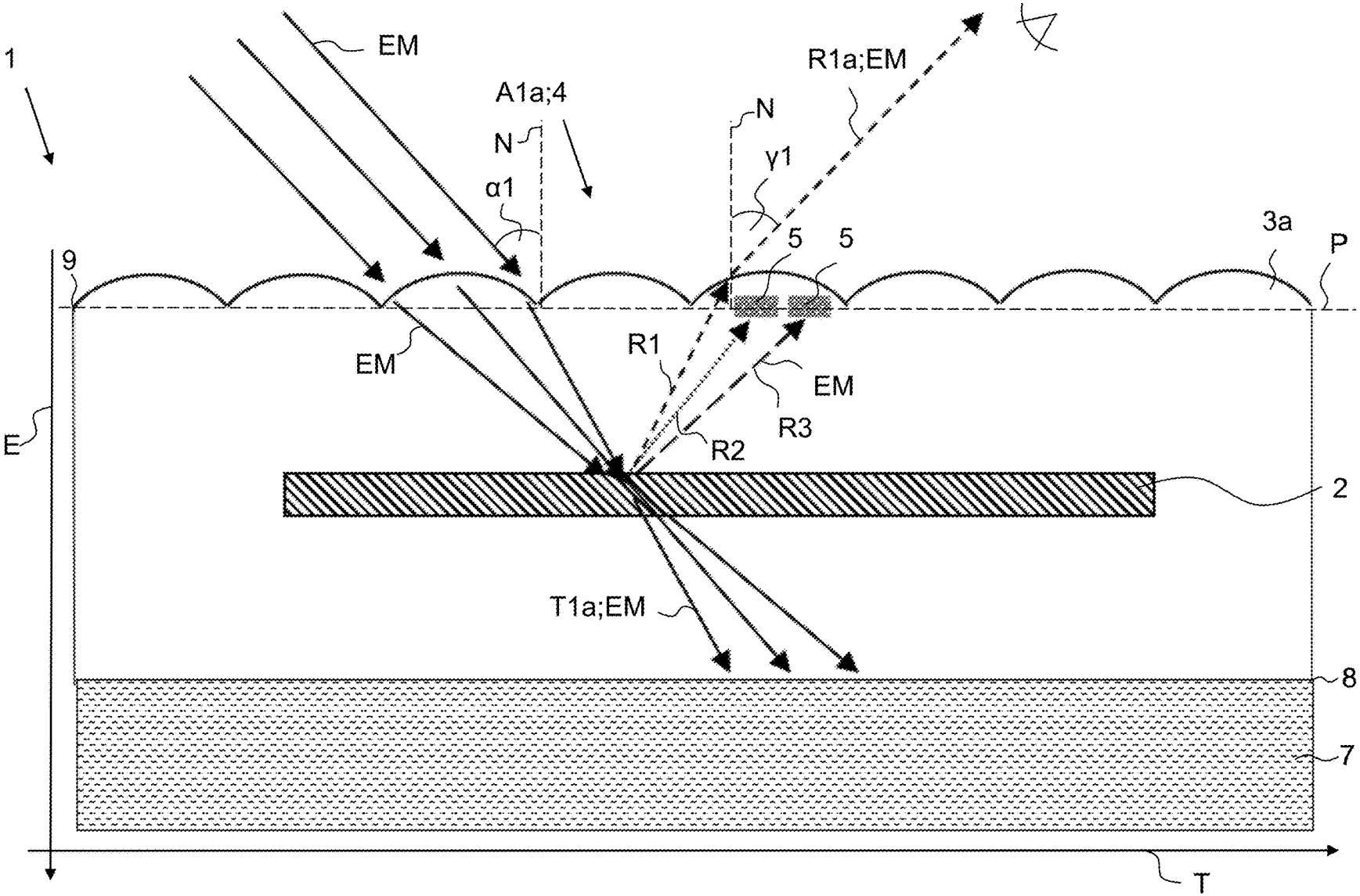
FIG. 5 shows a sectional view through a data carrier comprising an optically variable element and surface elements and blocking elements according to a further embodiment viewed under a first observation angle.
Figure 6A:
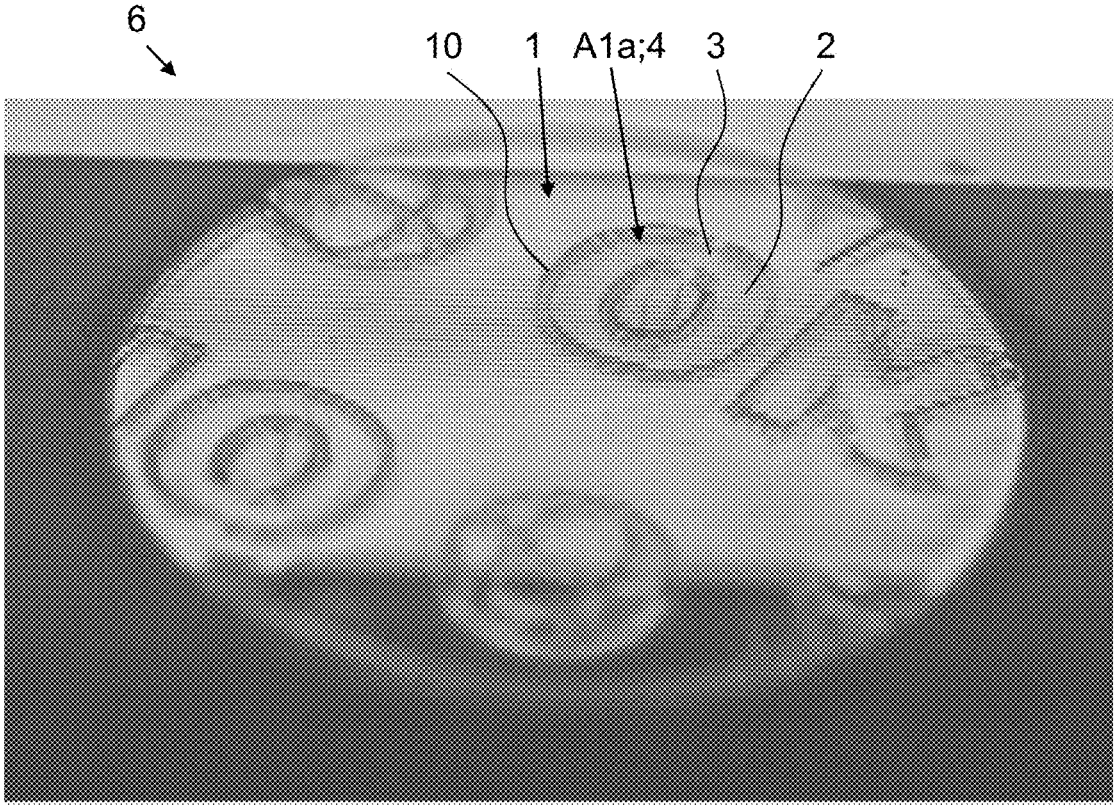
FIG. 6*a* shows a perspective view of a data carrier comprising an optically variable element and surface elements and blocking elements viewed under a first observation angle.
Figure 6B:
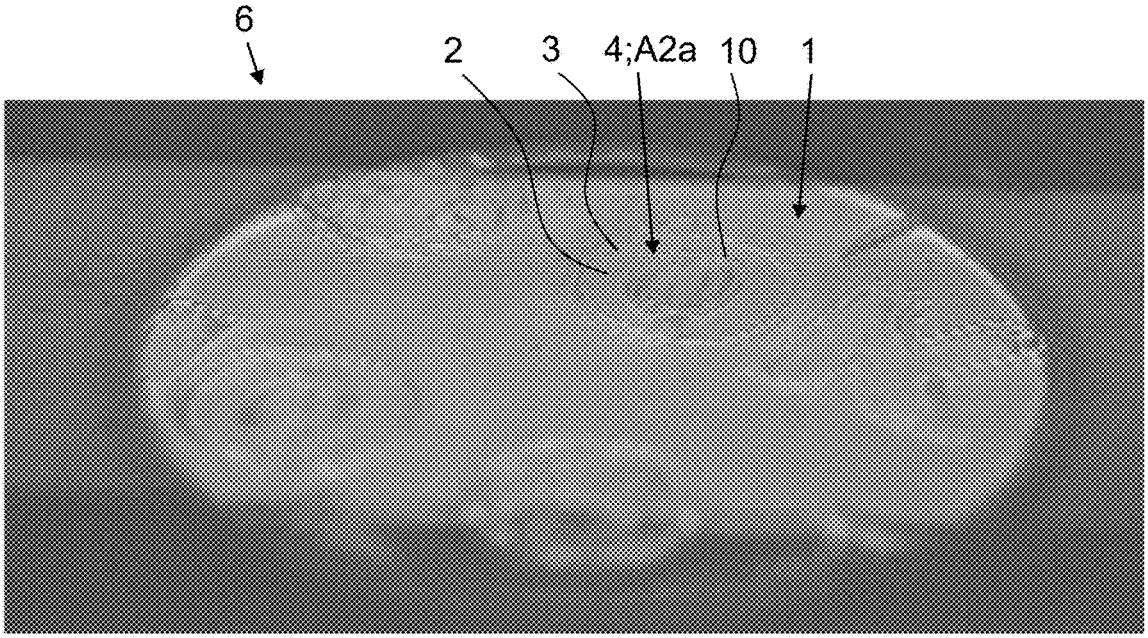
FIG. 6*b* shows a perspective view of the data carrier according to FIG. 6*a* viewed under a second observation angle.

As follows from FIGS. 4 and 5, the data carrier 1 can furthermore comprise blocking elements 5 which are configured to selectively block impinging electromagnetic radiation EM. In particular, in FIG. 4 two blocking elements 5 in the form of laser markings are provided on a left side and on a right side of one lens element 3*a*, wherein said blocking elements are configured to block two rays R1, R3 of electromagnetic radiation EM being reflected from the optically variable element 2. As a result, only one ray R2 of electromagnetic radiation EM being reflected from the optically variable element 2 is allowed to travel through the middle portion of said lens element 3*a* and towards an outside. In FIG. 5, two blocking elements 5 in the form of laser markings are provided in the middle and on the right side of a lens element 3*a*. Consequently, only one ray R1 of electromagnetic radiation EM is allowed to travel through the left side of the lens element 3*a* and towards an outside of the data carrier 1, whereas the other rays R2, R3 of reflected electromagnetic radiation EM are blocked by the blocking elements 5.

Figure 7:
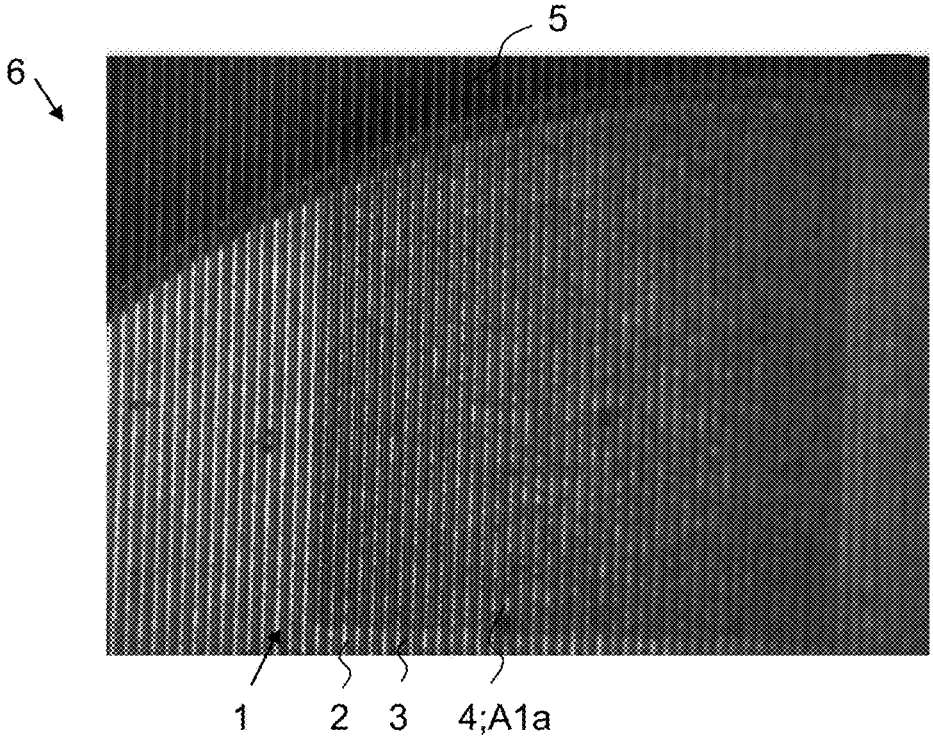
FIG. 7 shows a perspective view of a data carrier comprising an optically variable element and surface elements and blocking elements according to a further embodiment viewed under a first observation angle.
Figure 8:
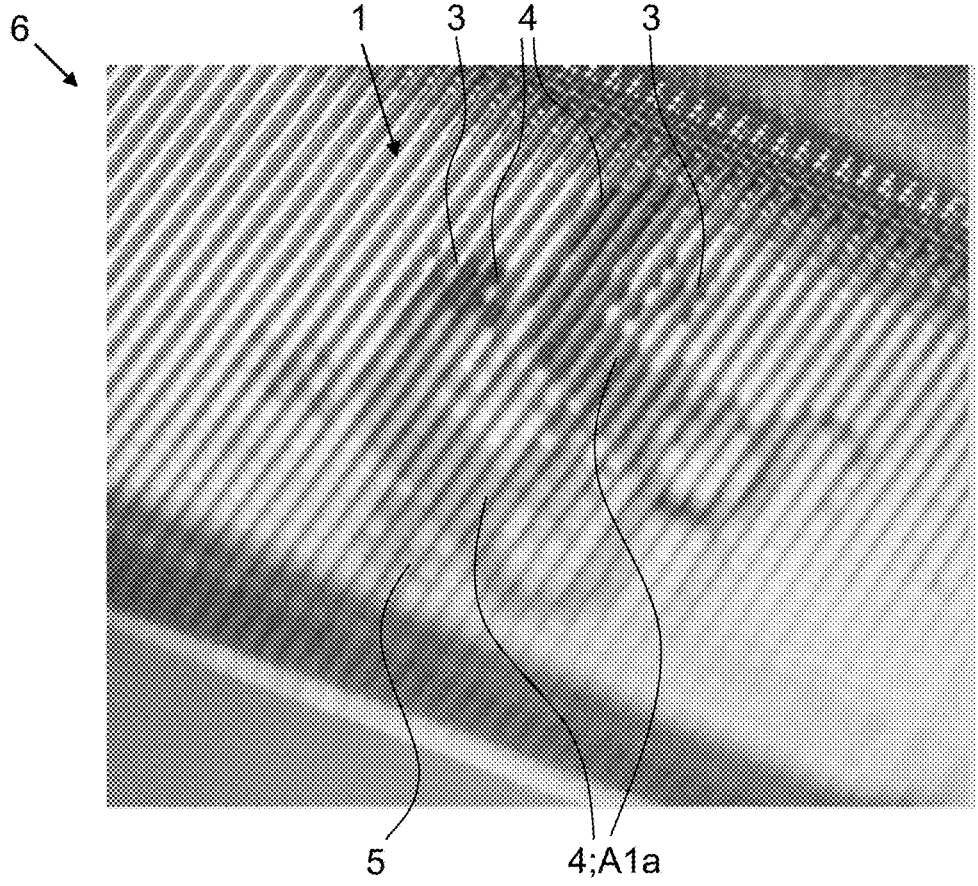
FIG. 8 shows a perspective view of a data carrier comprising an optically variable element and surface elements and blocking elements according to a further embodiment viewed under a first observation angle.

To this end it is particularly preferred to provide the blocking elements 5 as pixels of an image or alphanumeric character one wishes to generate in or on the data carrier 1. In fact, each blocking element 5 can correspond to one pixel of an image or alphanumeric character, wherein each blocking element 5 participates to selectively block a color. This phenomenon is illustrated in FIGS. 7 to 8, wherein an image in the form of a square (FIG. 7) as well as an image in the form of a gecko (FIGS. 7 and 8) are generated by means of blocking elements 5. Depending on the observation angle, electromagnetic radiation EM is incident on lens elements 3*a*, 3*b* and on the optically variable element 2 under one or more particular arrival angles α1, α2, β1, β2 and impingement angles δ1, ε1, respectively. Likewise, electromagnetic radiation EM being reflected from the optically variable element 2 is reflected from the optically variable element 2 and subsequently impinges on the lens elements 3*a*, 3*b* under particular outgoing angles, as well. By providing these blocking elements 5 it is possible to selectively block electromagnetic radiation EM that would otherwise impinge on the lens element 3*a*, 3*b* and/or on the optically variable element 2 under a particular angle. As a result, the one or more wavelengths that are associated with an impingement under said particular angle(s) are blocked or not generated within the data carrier 1, which enables a tuning of the color of the security element 4. In fact, depending on the location of the blocking element 5 within the lens element 3*a*, 3*b*, i.e. whether the blocking element 5 is arranged on a left side, in the middle, or on a right side of the lens element 3*a*, 3*b*, particular wavelengths can be blocked. In other words, the provision of blocking elements 5 enables a personalization of the data carrier 1 for a particular observation angle γ1, γ2. Namely, and as follows from FIGS. 7 to 8, the images are visible according to a first appearance A1*a* if viewed under a first observation angle γ1 and are visible according to a second appearance A2*a* if viewed under a second observation angle γ2. Although not evident from these figures, said images appear in color when viewed under the first observation angle γ1, whereas the laser markings 5 constituting said images appear as black and white features when viewed under observation angles being different from said first observation angle γ1.

It should be noted that a different appearances such as change in the reflection spectrum can also be obtained in other ways. Namely, and as follows from FIGS. 6*a* and 6*b*, it is conceivable to provide a deformation or embossment 10 on the optically variable element 2. Here, said deformation or embossment 10 corresponds to the alphanumeric character "OK", wherein at the location of this deformation or embossment 10 the reflection spectrum is changed as compared to the rest of the optically variable element 2, i.e. to those parts of the optically variable element where no deformation or embossment is present. As a consequence, different colors are seen, as well.

LIST OF REFERENCE SIGNS

| | | | |
|---|---|---|---|
| 1 | data carrier | R1a | first reflection spectrum |
| 2 | optically variable element | R2a | second reflection spectrum |
| 3a | surface element | R1 | light beam |
| 3b | surface element | R2 | light beam |
| 4 | security element | R3 | light beam |
| 5 | blocking element | T1 | light beam |
| 6 | security document | T2 | light beam |
| 7 | bottom element | T3 | light beam |
| 8 | bottom side | T1a | first transmittance spectrum |
| 9 | uppermost surface | T2a | second transmittance |
| 10 | embossment | | spectrum |
| EM | electromagnetic radiation | A1a | first appearance |
| α1 | first arrival angle | A2a | second appearance |
| α2 | further first arrival angle | E | extension direction |
| β1 | second arrival angle | T | transverse direction |
| β2 | further second arrival angle | F | focus |
| γ1 | first observation angle | N | normal |
| γ2 | second observation angle | va | vertical distance |
| δ1 | first impingement angle | vb | vertical distance |
| ε1 | second impingement angle | | |

The invention claimed is:

1. A data carrier comprising:

at least one optically variable element;

at least one surface element; and at least one security element comprising at least part of the at least one optically variable element and at least part of the at least one surface element, wherein the at least one optically variable element is arranged beneath the at least one surface element, wherein the at least one surface element is configured to guide impinging electromagnetic radiation towards the at least one optically variable element, wherein the at least one optically variable element is configured to reflect at least a first reflection spectrum upon impingement of the electromagnetic radiation on the at least one surface element under a first arrival angle, whereby the at least one security element appears according to at least a first appearance, wherein the at least one optically variable element is further configured to reflect at least a second reflection spectrum upon impingement of the electromagnetic radiation on the at least one surface element under a second arrival angle, whereby the at least one security element appears according to at least a second appearance being different from the first appearance, and wherein the data carrier comprises at least one blocking element, and wherein said blocking element is configured to block impinging electromagnetic radiation, whereby a further impingement of said electromagnetic radiation on the optically variable element is prevented and/or whereby electromagnetic radiation being reflected from the optically variable element is blocked.

2. The data carrier according to claim 1, wherein the optically variable element is configured such, that it is transparent for impinging electromagnetic radiation constituting a first impingement spectrum and that it is reflective for impinging electromagnetic radiation constituting a second impingement spectrum being different from the first impingement spectrum.

3. The data carrier according to claim 1, wherein the optically variable element is arranged within the data carrier whereby the optically variable element lies above or below or at a focal point of the electromagnetic radiation being guided from the surface element to the optically variable element, and/or wherein the surface element and the optically variable element are separated by a vertical distance such that a focal point of the electromagnetic radiation being guided from the surface element to the optically variable element lies above or below or at the optically variable element.

4. The data carrier according to claim 1, wherein the optically variable element is configured such, that the electromagnetic radiation that impinges on the surface element under the at least one first arrival angle and the electromagnetic radiation constituting the at least one first reflection spectrum are the same or different from one another, and/or wherein the optically variable element is configured such, that the electromagnetic radiation that impinges on the surface element under the at least one second arrival angle and the electromagnetic radiation constituting the at least one second reflection spectrum are the same or different from one another.

5. The data carrier according to claim 1, wherein the optically variable element is configured to transmit at least part of the electromagnetic radiation upon impingement of the electromagnetic radiation on the at least one surface element under the at least one first arrival angle —as at least a first transmittance spectrum—, and wherein the at least one first transmittance spectrum —differs from the at least one first reflection spectrum—, and/or wherein the optically variable element is configured to transmit at least part of the electromagnetic radiation upon impingement of the electromagnetic radiation on the at least one surface element under the at least one second arrival angle as at least a second transmittance spectrum, and wherein the at least one second transmittance spectrum differs from the at least one second reflection spectrum.

6. The data carrier according to claim 1, wherein the blocking element is at least one of a laser marking and an opaque material of at least a portion of a pixel of at least one of an alphanumeric character and an image.

7. The data carrier according to claim 1, wherein two or more surface elements are provided in an array and/or according to a pattern.

8. The data carrier according to claim 1 further comprising at least one further surface element that is configured to guide impinging electromagnetic radiation towards the optically variable element, wherein the data carrier is further configured such, that electromagnetic radiation is impinging on the at least one further surface element under the first arrival angle when the data carrier is seen under the first observation angle, and wherein the at least one optically variable element is configured to reflect at least a third reflection spectrum upon impingement of the electromagnetic radiation on the at least one further surface element under the first arrival angle that is different from the first reflection spectrum, whereby the at least one security element appears according to at least a third appearance that is different from the first appearance, and/or wherein the data carrier is further configured such, that electromagnetic radiation is impinging on the at least one further surface element under the second arrival angle when the data carrier is seen under the second observation angle, and wherein the at least one optically variable element is configured to reflect at least a fourth reflection spectrum upon impingement of the electromagnetic radiation the at least one further surface element under the second arrival angle that is different from the second reflection spectrum, whereby the at least one security element appears according to at least a fourth appearance that is different from the second appearance.

9. The data carrier according to claim 8, wherein the surface element comprises one or more lenses, and wherein the one or more lenses are of a cylindrical lens shape and/or of a spherical lens shape.

10. The data carrier according to claim 1, wherein the surface element and/or the further surface element comprise or consist of a polymer.

11. The data carrier according to claim 1, further comprising a transparent region, wherein the security element is arranged within said region and/or above said region and/or beneath said region.

12. A security document comprising:

at least one data carrier having:

at least one optically variable element;

at least one surface element; and at least one security element comprising at least part of the at least one optically variable element and at least part of the at least one surface element, wherein the at least one optically variable element is arranged beneath the at least one surface element, wherein the at least one surface element is configured to guide impinging electromagnetic radiation towards the at least one optically variable element, wherein the at least one optically variable element is configured to reflect at least a first reflection spectrum upon impingement of the electromagnetic radiation on the at least one surface element under the first arrival angle, whereby the at least one security element appears according to at least a first appearance, wherein the at least one optically variable element is further configured to reflect at least a second reflection spectrum upon impingement of the electromagnetic radiation on the at least one surface element under the second arrival angle, whereby the at least one security element appears according to at least a second appearance being different from the first appearance, and wherein the data carrier comprises at least one blocking element, and wherein said blocking element is configured to block impinging electromagnetic radiation, whereby a further impingement of said electromagnetic radiation on the optically variable element is prevented and/or whereby electromagnetic radiation being reflected from the optically variable element is blocked.

13. The security document of claim 12 being an identity card, a passport, a credit card, or a bank note.

14. A method of producing a data carrier, comprising the steps of:

providing at least one optically variable element;

providing at least one surface element; and providing at least one security element comprising at least part of the at least one optically variable element and at least part of the at least one surface element, wherein the at least one optically variable element is arranged below the at least one surface element, wherein the at least one surface element is configured to guide electromagnetic radiation that is impinging on the at least one surface element to the at least one optically variable element, wherein the at least one optically variable element is configured to reflect at least a first reflection spectrum upon impingement of the electromagnetic radiation on the at least one surface element under a first arrival angle, whereby the at least one security element appears according to at least a first appearance, wherein the at least one optically variable element is further configured to reflect at least a second reflection spectrum upon impingement of the electromagnetic radiation on the at least one surface element under a second arrival angle, whereby the at least one security element appears according to at least a second appearance being different from the first appearance, and wherein the data carrier comprises at least one blocking element, and wherein said blocking element is configured to block impinging electromagnetic radiation, whereby a further impingement of said electromagnetic radiation on the optically variable element is prevented and/or whereby electromagnetic radiation being reflected from the optically variable element is blocked.

* * * * *